US012023560B2

(12) United States Patent
Rubac

(10) Patent No.: US 12,023,560 B2
(45) Date of Patent: Jul. 2, 2024

(54) GOLF AIMING DEVICES, GOLF TEES FOR USE IN A GOLF AIMING DEVICE, AND METHODS FOR USING THE SAME

(71) Applicant: Chuck Rubac, Annapolis, MD (US)

(72) Inventor: Chuck Rubac, Annapolis, MD (US)

( * ) Notice: Subject to any disclaimer, the term of this patent is extended or adjusted under 35 U.S.C. 154(b) by 0 days.

(21) Appl. No.: 17/702,990

(22) Filed: Mar. 24, 2022

(65) Prior Publication Data

US 2023/0302338 A1 Sep. 28, 2023

(51) Int. Cl.
*A63B 57/19* (2015.01)

(52) U.S. Cl.
CPC ..... *A63B 57/19* (2015.10)

(58) Field of Classification Search
CPC ..... A63B 57/19; A63B 57/10
See application file for complete search history.

(56) References Cited

U.S. PATENT DOCUMENTS

| | | | | | |
|---|---|---|---|---|---|
| 3,001,529 | A * | 9/1961 | Watson | A24F 13/22 | 131/257 |
| D210,837 | S * | 4/1968 | Warner | 473/402 | |
| 4,669,725 | A * | 6/1987 | Taylor | A63B 57/19 | 473/391 |
| 4,838,285 | A * | 6/1989 | Petrone | A63B 57/10 | 473/282 |
| D431,849 | S * | 10/2000 | MacDonald | D21/718 | |
| D491,990 | S * | 6/2004 | Lu | D21/717 | |
| D583,428 | S * | 12/2008 | Worth | D21/718 | |
| D865,883 | S * | 11/2019 | Hayes | D21/712 | |
| 11,278,778 | B1 * | 3/2022 | Dean, Jr. | A63B 57/10 | |
| 2006/0223655 | A1 * | 10/2006 | Breton | A63B 57/10 | 473/387 |
| 2006/0258483 | A1 * | 11/2006 | Hannah | A63B 57/19 | 473/402 |
| 2008/0020868 | A1 * | 1/2008 | Palmer | A63B 69/3667 | 473/409 |

(Continued)

FOREIGN PATENT DOCUMENTS

KR 102046721 B1 * 11/2019

OTHER PUBLICATIONS

National Library of Medicine, "Cigarette Design Features: Effects on Emission Levels, User Perception, and Behavior", Jan. 4, 2018, Tob Regul Sci, pp. 1-21, retrieved from internet on Nov. 6, 2023, <https://www.ncbi.nlm.nih.gov/pmc/articles/PMC5730088/>. (Year: 2018).*

*Primary Examiner* — Steven B Wong
(74) *Attorney, Agent, or Firm* — Tollefson IP

(57) ABSTRACT

A novel golf tee is adapted as an aiming device. The golf tee includes a shaft having a tapered end for insertion into a playing surface. The golf tee includes a platform coupled with an end of the shaft opposite of the tapered end. The platform has a top surface that is concave in shape and configured to hold a golf ball and a groove passing through the platform perpendicular to the axis of the shaft. The groove extends in the direction of the axis of the shaft through the top surface of the platform, bisecting the top surface to form first and second opposing sides of the platform. The groove includes a bore section. The bore section of the groove is larger in diameter than a width of the groove measured from the first to the second opposing sides of the platform.

9 Claims, 16 Drawing Sheets

(56) References Cited

U.S. PATENT DOCUMENTS

| | | | | |
|---|---|---|---|---|
| 2009/0118041 | A1* | 5/2009 | Manson | A63B 57/10<br>473/387 |
| 2010/0216576 | A1* | 8/2010 | Sanders | A63B 57/16<br>473/387 |
| 2013/0012332 | A1* | 1/2013 | Leyva | A63B 57/19<br>473/409 |
| 2013/0190101 | A1* | 7/2013 | Mabrey | A63B 57/10<br>473/257 |
| 2013/0310200 | A1* | 11/2013 | Nelson | A63B 57/10<br>473/401 |
| 2019/0030406 | A1* | 1/2019 | Baker | A63B 57/10 |
| 2019/0381376 | A1* | 12/2019 | Cotton | A63B 57/207 |

* cited by examiner

Front view

Side view

Bottom View

Top view

Angled Front View

Fig. 3b Angled side view

Angled Top View

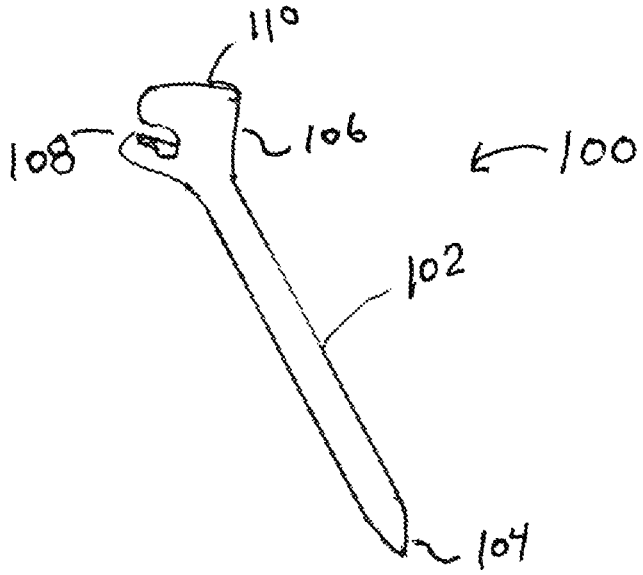
FIG 3.d Bottom perspective view
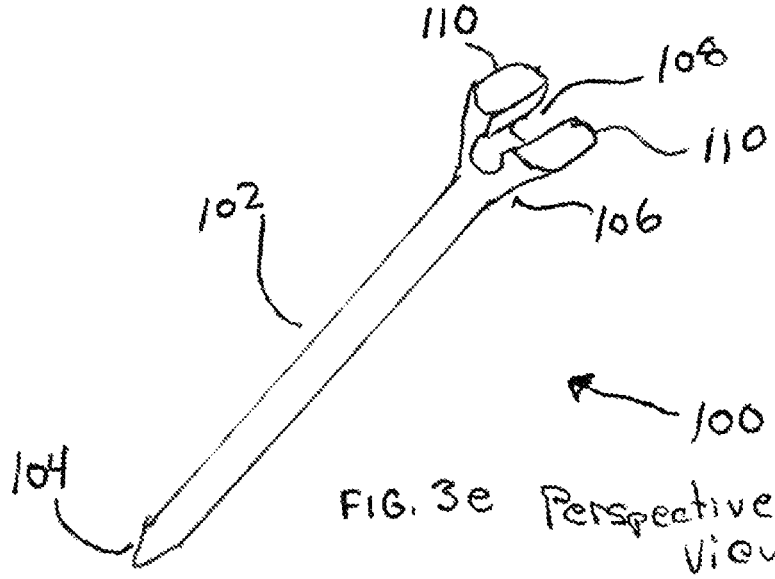
FIG. 3e Perspective view

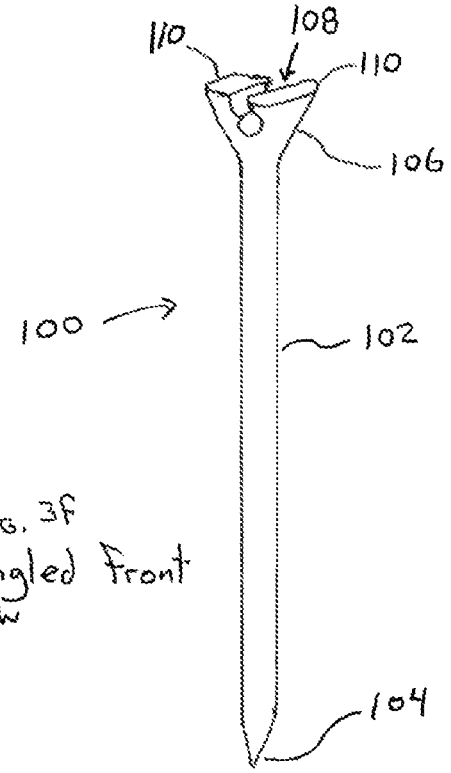
Fig. 3f
Second Angled Front View
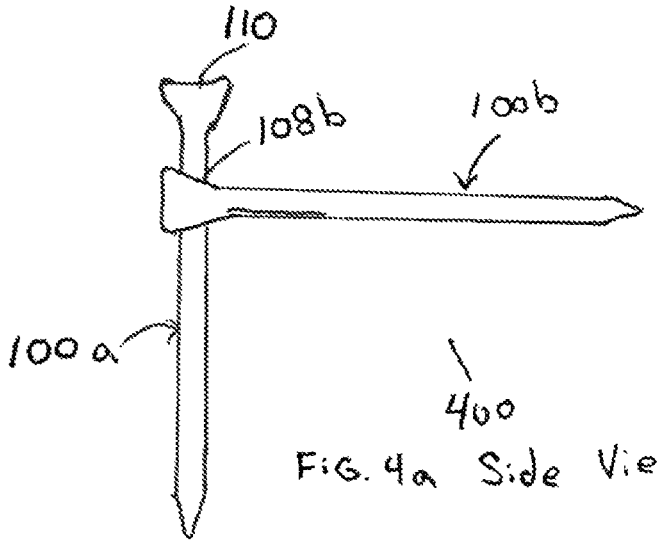
Fig. 4a Side View

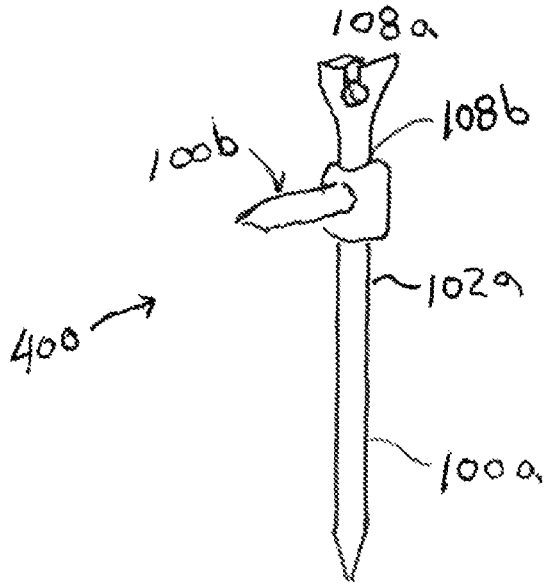
Fig. 4b Front View
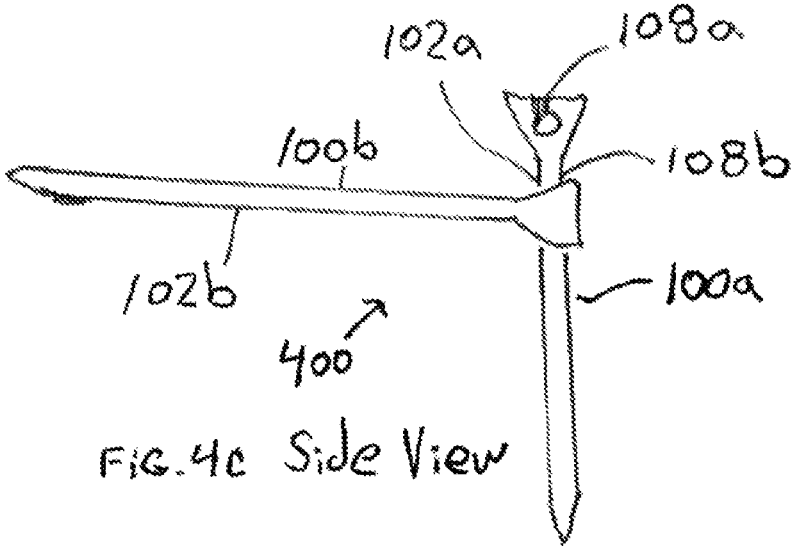
Fig. 4c Side View

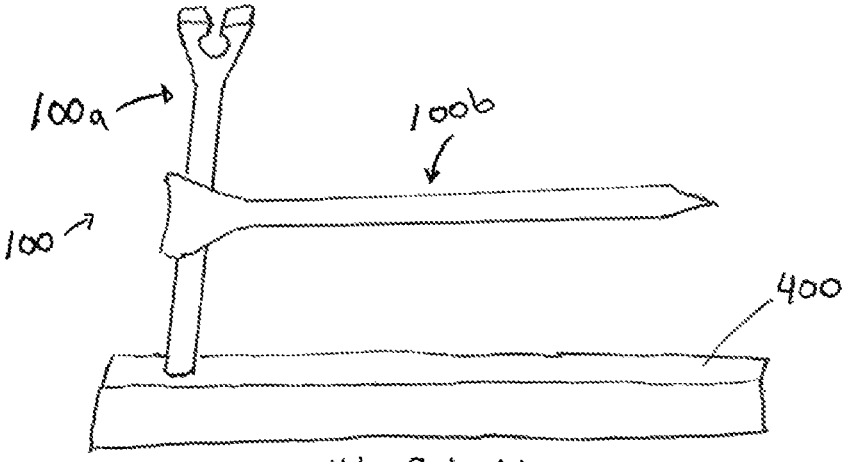
Fig. 4d Side View
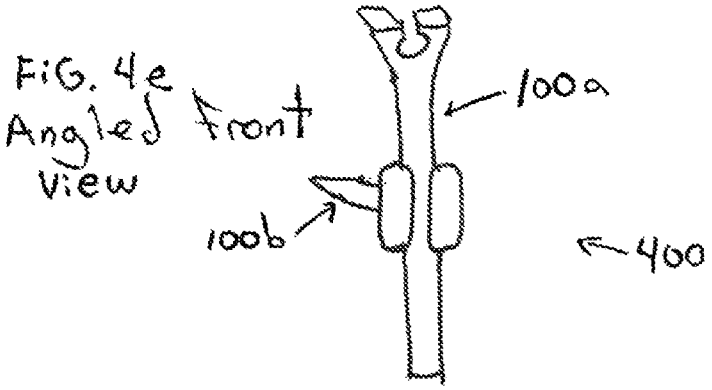
Fig. 4e Angled Front View
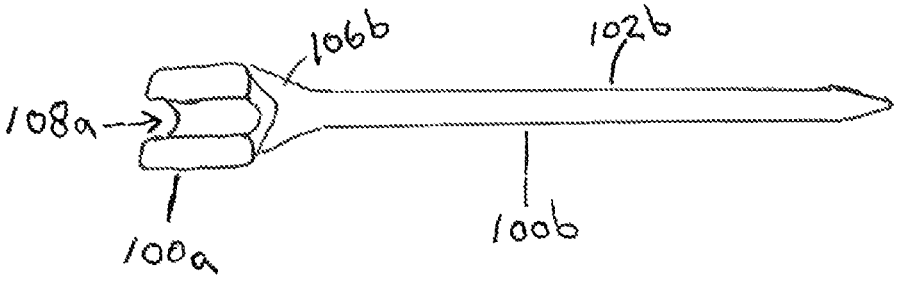
Fig. 4F Top View TOP View Fig. 5a Side View
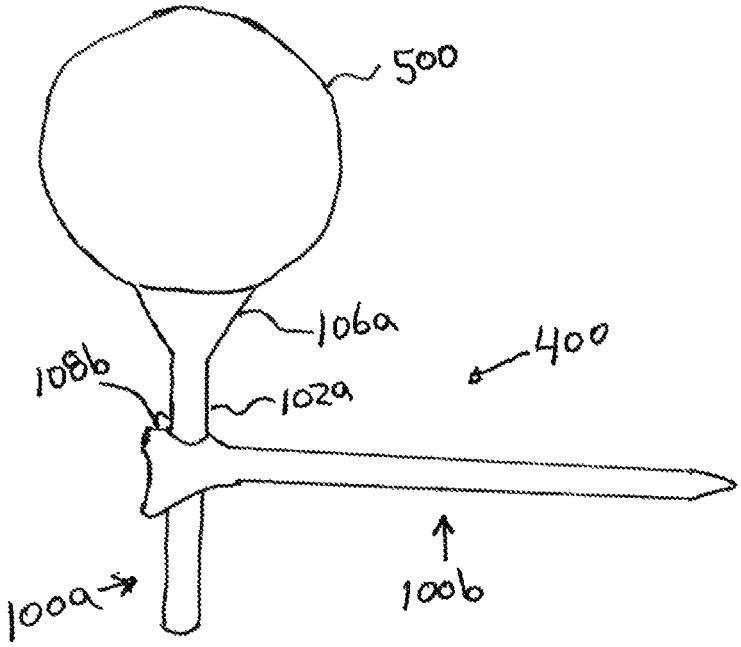
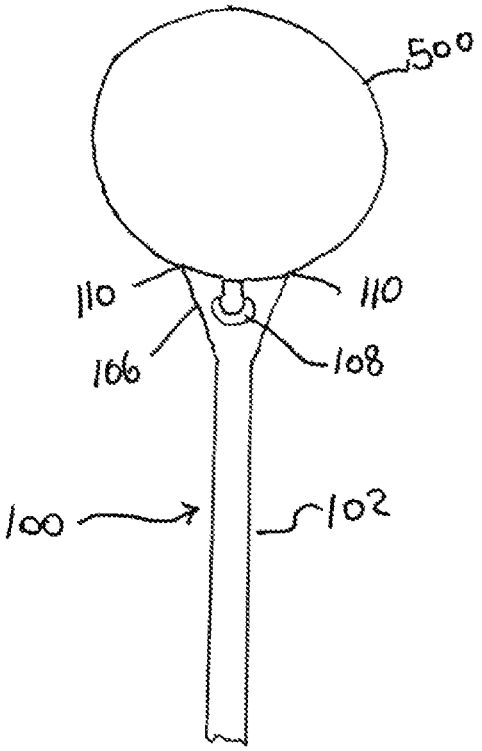
FiG5b Front View Side View FIG. 6C Top view
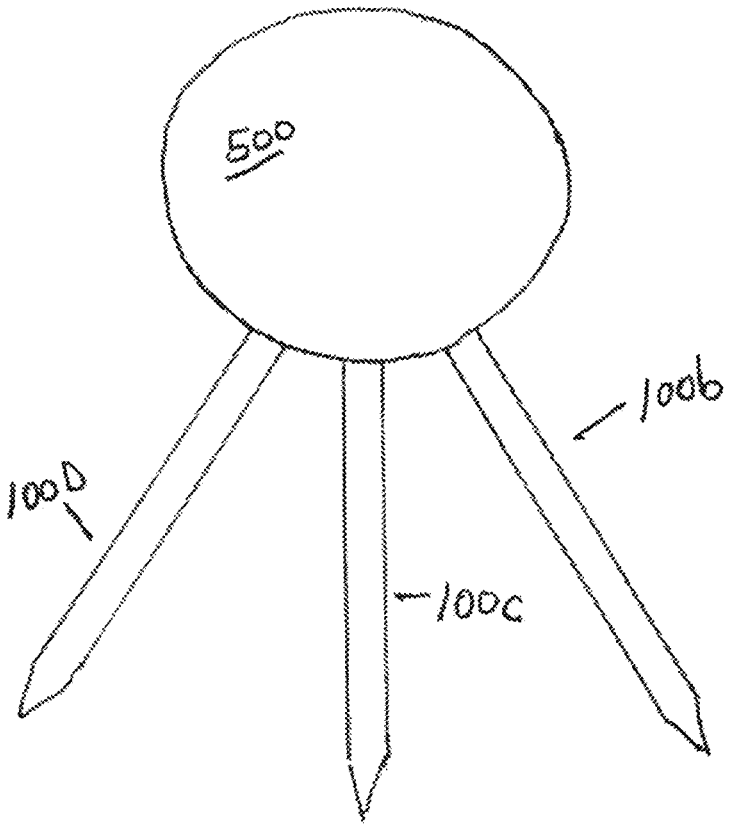

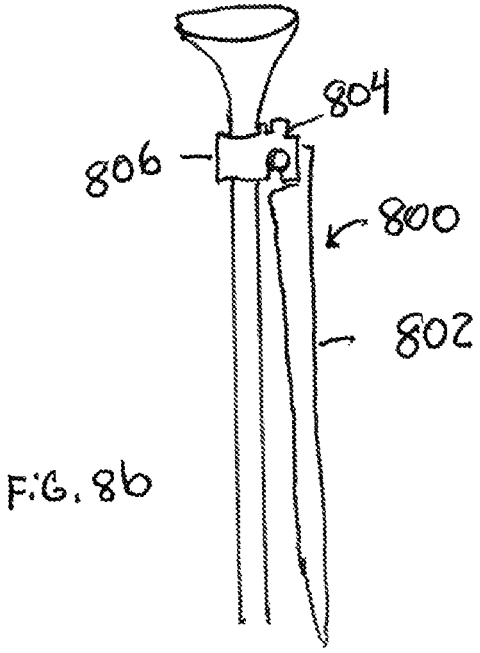
FIG. 8b
FIG. 8c
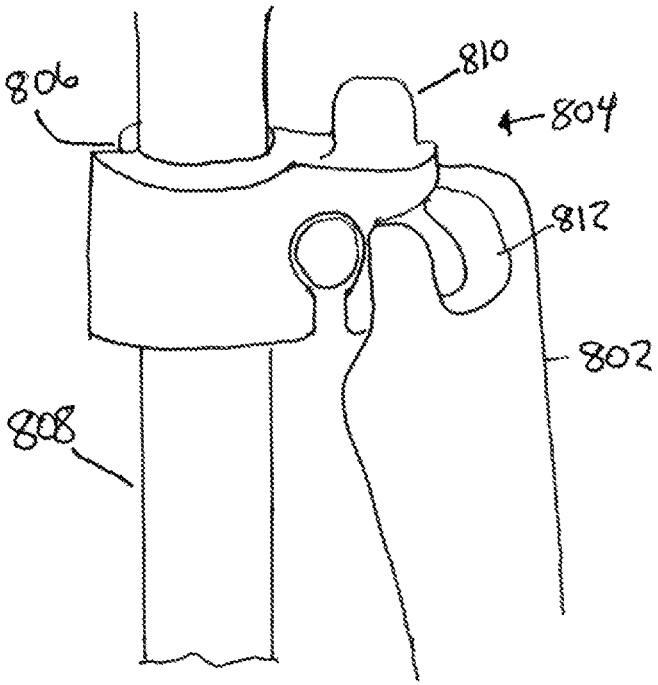

GOLF AIMING DEVICES, GOLF TEES FOR USE IN A GOLF AIMING DEVICE, AND METHODS FOR USING THE SAME

BACKGROUND

Field of the Invention

The present invention relates generally to training devices for golf. More specifically, the invention relates to novel golf tees and aiming devices, and methods for using the golf tees and aiming devices.

Description of the Related Art

Golf is one of the most popular games in the world. Despite its popularity, golf is also one of the most difficult games to master. A player's grip of the golf club, stance, and swing are critical to hitting a golf ball with distance and accuracy. What good is distance if your shot is not accurate? Making an accurate shot is important but difficult. The golf swing is a complicated motion and training devices are popular for improving the same.

The golf drive is one of the most important swings a golfer can perform. A golf ball is placed on a golf tee—a thin, wood or plastic peg, about three inches in height, atop which a golf ball sits in a stable and stationary position. The tee is pushed down into grass or some other ground substrate (e.g., a tee box made of artificial turf, dirt, etc.), leaving a portion of the tee above ground, and a golf ball is placed atop the golf tee in a raised position. A golfer uses a driver or other club to hit the golf ball off the tee in a selected direction.

Alignment of the player's swing affects the trajectory and distance that the ball will travel. For example, a closed swing might result in a dramatic curving action of the trajectory called a "hook"; while an open swing might result in a dramatic curving action of the trajectory called a "slice." Depending on the circumstances, a player may desire to hit the ball straight, or with varying degrees of controlled slicing or hooking (e.g., fading or drawing the ball toward a target on a trajectory).

Since a golf swing can be such a difficult thing to improve, a training aid is often necessary. Some devices exist that will help a golfer control their swinging action to achieve a desired result. Yet existing golf aids all suffer from deficiencies. Some are too complicated. Others are too large to carry or difficult to use on a golf course. Others can be very expensive.

Thus, there are needs for improved golf alignment and aiming devices that are simple, easy to use, and easy to carry.

SUMMARY OF THE INVENTION

The subject invention solves problems in the prior art by providing an aiming device comprising one or more uniquely configured golf tees.

According to embodiments of the invention, a golf tee is formed to have a groove in its top, platform portion (the "crown" end) atop which a golf ball can rest in a stable position. The tee has a pointed shaft for being pushed down into turf or some other tee-box ground substrate. The platform portion is thicker than the shaft and sized to hold a golf ball. The groove includes a bore section that is substantially circular in cross-section and which passes entirely through platform portion of the tee, and is sized such that the shaft of another tee can be passed there through. Preferably, the bore is size for a tight fit with the shaft of another tee to form a stable coupling.

According to embodiments of the present invention, the tee may be formed out of known materials, such as hard or soft plastics, PVC, fiber filled plastics, polyethylene, wood, composite, metal, etc. The tee maybe be formed to be rigid or deformable. If deformable, the bore can be sized accordingly to clamp onto the shaft of another tee. The tee may also include a slightly tapered shaft to allow another tee of the present invention to be slide up the shaft into a tighter coupling the higher it is slid.

According to embodiments of the invention, the tee may be formed by molding (e.g., plastic injection molding), extrusion, cutting and boring, or other known methods of fabrication.

The claimed subject matter is not limited to implementations that solve any or all disadvantages noted in any part of this disclosure.

According to embodiments of the present invention, a golf tee is adapted as an aiming device. The golf tee includes a shaft having a tapered end for insertion into a playing surface. The golf tee includes a platform coupled with an end of the shaft opposite of the tapered end. The platform has a top surface that is concave in shape and configured to hold a golf ball and a groove passing through the platform perpendicular to the axis of the shaft. The groove extends in the direction of the axis of the shaft through the top surface of the platform, bisecting the top surface to form first and second opposing sides of the platform. The groove includes a bore section. The bore section of the groove is larger in diameter than a width of the groove measured from the first to the second opposing sides of the platform. One or more such golf tees may be coupled to the shaft of another golf tee to form a novel aiming device, according to embodiments of the present invention.

The present invention will become more fully understood from the forthcoming detailed description of preferred embodiments read in conjunction with the accompanying drawings. Other benefits and advantages of the present invention will become apparent to those skilled in the art upon a reading and understanding of the preferred embodiments. Both the detailed description and the drawings are given by way of illustration only, and are not limitative of the present invention.

BRIEF DESCRIPTION OF THE DRAWINGS

FIG. 3*b* is an illustration of angled side view of a golf tee according to an embodiment of the present invention.

FIG. 3*d* is an illustration of bottom perspective view of a golf tee according to an embodiment of the present invention.

FIG. 3*e* is an illustration of perspective view of a golf tee according to an embodiment of the present invention.

FIG. 3*f* is an illustration of second angled front view of a golf tee according to an embodiment of the present invention.

FIG. 4*a* is an illustration of side view of an aiming device formed by coupling a golf tee with another golf tee according to an embodiment of the present invention.

FIG. 4*b* is an illustration of front view of an aiming device formed by coupling a golf tee with another golf tee according to an embodiment of the present invention.

FIG. 4*c* is an illustration of side view of an aiming device formed by coupling a golf tee with another golf tee according to an embodiment of the present invention.

FIG. 4*d* is an illustration of side view of an aiming device formed by coupling a golf tee with another golf tee according to an embodiment of the present invention.

FIG. 4*e* is an illustration of angled front view of an aiming device formed by coupling a golf tee with another golf tee according to an embodiment of the present invention.

FIG. 4*f* is an illustration of top view of an aiming device formed by coupling a golf tee with another golf tee according to an embodiment of the present invention.

FIG. 5*a* is an illustration of side view of a golf tee according to an embodiment of the present invention.

FIG. 5*b* is an illustration of front view of a golf tee according to an embodiment of the present invention.

FIG. 6*c* is a picture of an aiming device with three tees coupled to tee 100*a* for a different training arrangement according to an embodiment of the present invention.

FIG. 8B is an illustration of a side view of the aiming device of FIG. 8A in a folded position, according to another embodiment of the present invention.

FIG. 8C is close up view of the coupling mechanism and hinge of the aiming device of FIG. 8A in a folded position, according to another embodiment of the present invention.

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

While the present invention may be embodied in many different forms, a number of illustrative embodiments are described herein with the understanding that the present disclosure is to be considered as providing examples of the principles of the invention and such examples are not intended to limit the invention to any specific preferred embodiments described and/or illustrated herein. The following description of embodiments of the present invention utilize the defined terms and variables found below.

FIGS. 1-6 illustrate various views of golf tees and aiming devices according to embodiments of a first aspect of the invention. In particular, a golf tee is formed so as to have a groove in its top, platform portion, atop which a golf ball can rest in a stable position. The tee has a pointed shaft for being pushed down into turf or some other tee-box ground substrate. The platform portion is thicker than the shaft and sized to hold a golf ball. The groove includes a bore section that is substantially circular in cross-section and which passes entirely through platform portion of the tee, and is sized such that the shaft of another tee can be passed there through. Preferably, the bore is size for a tight fit with the shaft of another tee to form a stable coupling.

According to embodiments of the present invention, the tee may be formed out of known materials, such as hard or soft plastics, PVC, fiber filled plastics, polyethylene, wood, composite, metal, etc. The tee maybe be formed to be rigid or deformable. If deformable, the bore can be sized accordingly to clamp onto the shaft of another tee. The tee may also include a slightly tapered shaft to allow another tee of the present invention to be slide up the shaft into a tighter coupling the higher it is slid. Preferably, the tees and components of the invented aiming devices are formed by injection molding high quality, high impact engineering grade nylon resin, using the most modern equipment available to produce tees to ensure consistency from part to part and to optimize durability.

Figure 1A:
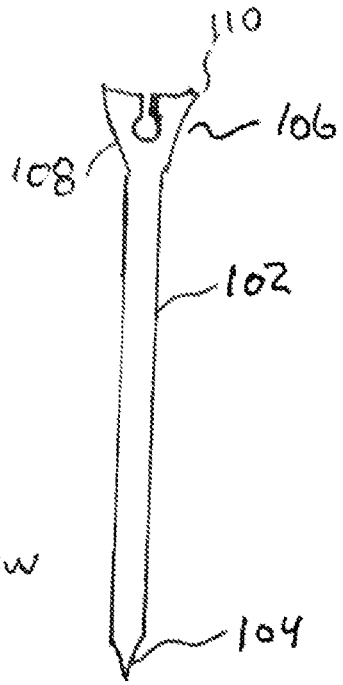
FIG. 1*a* is an illustration of front view of a golf tee according to an embodiment of the present invention.

Referring to FIG. 1*a*, a tee 100 includes a shaft 102 with a pointed or tapered end 104, an upper platform 106 through which a bore or groove 108 is formed, and having a top surface 110 for holding a golf ball in place. As shown, the groove 108 includes a portion having a circular cross section similar in size as the outer circumference of the shaft 102, which allows the tee to be slide upon and coupled with the shaft of another tee.

Figure 1B:
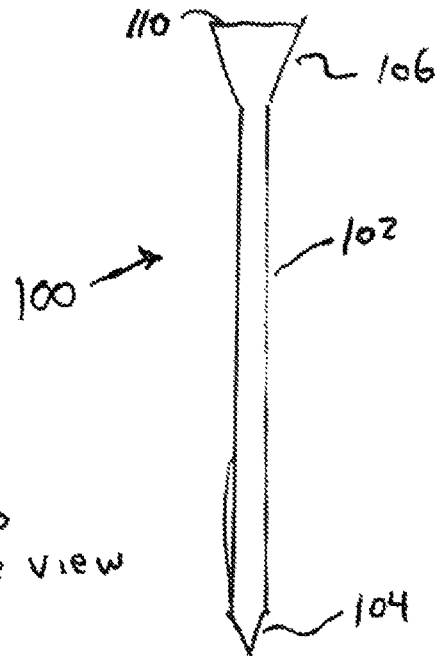
FIG. 1B is an illustration of side view of a golf tee according to an embodiment of the present invention.

Referring to FIG. 1B, as can be seen from the side view, the platform section 106 is preferably solid on the sides to provide support for the golf ball and for help form the upper surface 110.

Figure 2A:
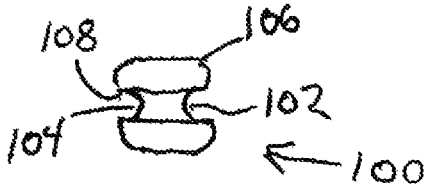
FIG. 2*a* is an illustration of bottom view of a golf tee according to an embodiment of the present invention.

Referring to FIG. 2*a*, the tee 100 may have portions removed from the platform section 106 where the groove 108 passes there through, forming the shape as seen from the bottom.

Figure 2B:
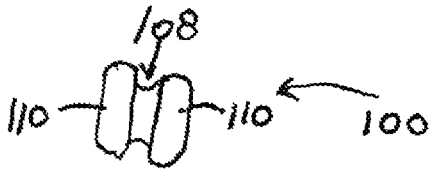
FIG. 2*b* is an illustration of top view of a golf tee according to an embodiment of the present invention.

Referring to FIG. 2*b*, the top surface 110 is formed by two opposing sides of the groove 108 and include sufficient surface for holding a golf ball.

Figure 3A:
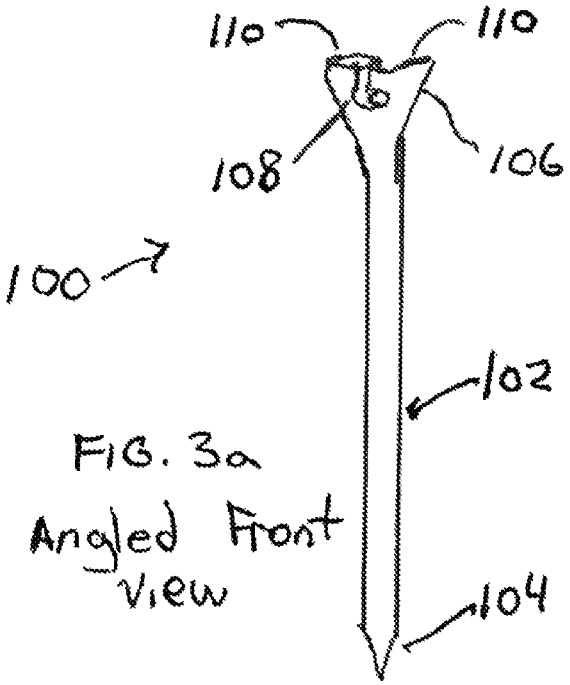
FIG. 3*a* is an illustration of angled front view of a golf tee according to an embodiment of the present invention.
Figure 3C:
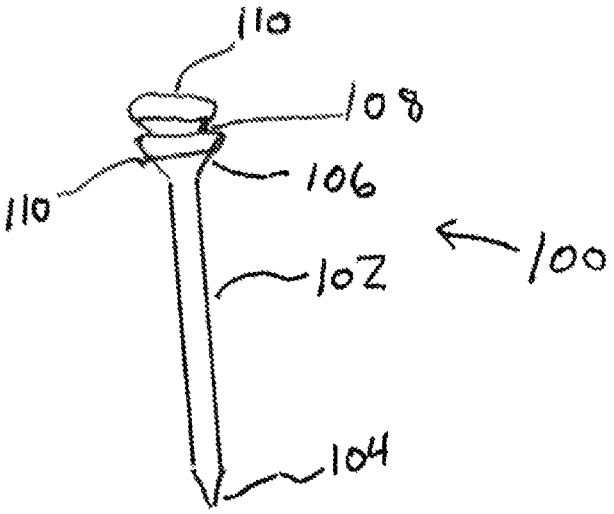
FIG. 3*c* is an illustration of angled top view of a golf tee according to an embodiment of the present invention.
Figure 3C:
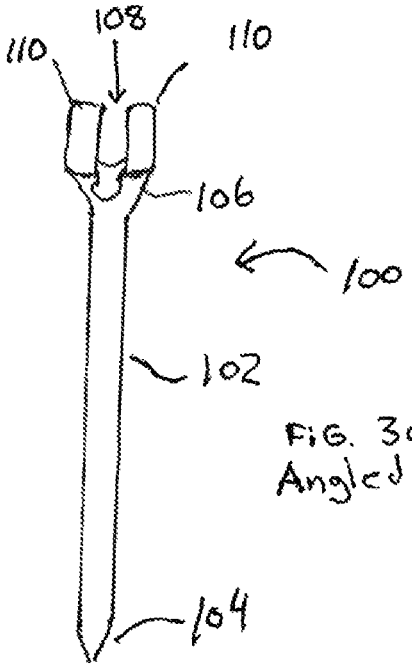

Referring to FIG. 3*a*, the contours of the top surface 110 can be seen, which preferably, are shaped to fit or match the external surface of a golf ball.

Referring to FIG. 3*b*, the contours of the top surface 110 can be seen, which preferably, are shaped to fit or match the external surface of a golf ball, and the groove 108 is preferably formed straight through the center of the upper platform portion 110, according to an embodiment of the present invention.

FIGS. 3*d-f* show additional views of the tee 100 according to an embodiment of the present invention from various angles. The skilled person will readily understand that the shape of the golf tee 100 is not limited as precisely shown and can be altered to improve features therefore or to reduce cost of manufacturing.

Figure 4G:
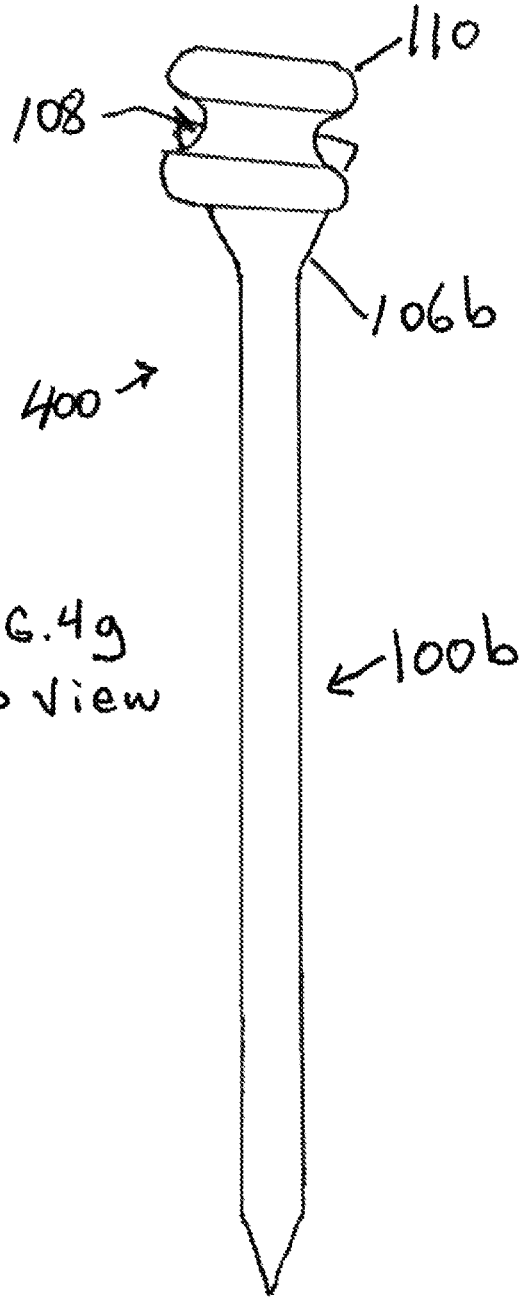
FIG. 4*g* is an illustration of top view of an aiming device formed by coupling a golf tee with another golf tee according to an embodiment of the present invention.

FIG. 4*a* is a side view of two tees 100*a* and 100*b* coupled together to form an aiming device 400. As shown, according to embodiments of the invention, a first tee 100*a* may be provided for teeing up a golf ball, while a second tee 100*b* is coupled onto the shaft of tee 100*a* via a groove 108*b* in tee 100*b*. The tee 100*b* may be slid upon the shaft of 100*a*, or if the tee 100*b* is formed of deformable materials, can be popped or snapped onto the shaft of tee 100*a*. Preferably, the groove 108*b* is sized for a tight fit onto a shaft but loose enough to be adjustable in position along the shaft. Thereby, the shaft of second tee 100*b* becomes a pointer, which can be aligned by a golfer as an aiming device. FIGS. 4*b-g* show various angles of the aiming device 400, which illustrate both the configuration and use of the device. Notably, FIGS. 4*f-g* show top views which illustrate a view that a golfer may see.

Figure 5C:
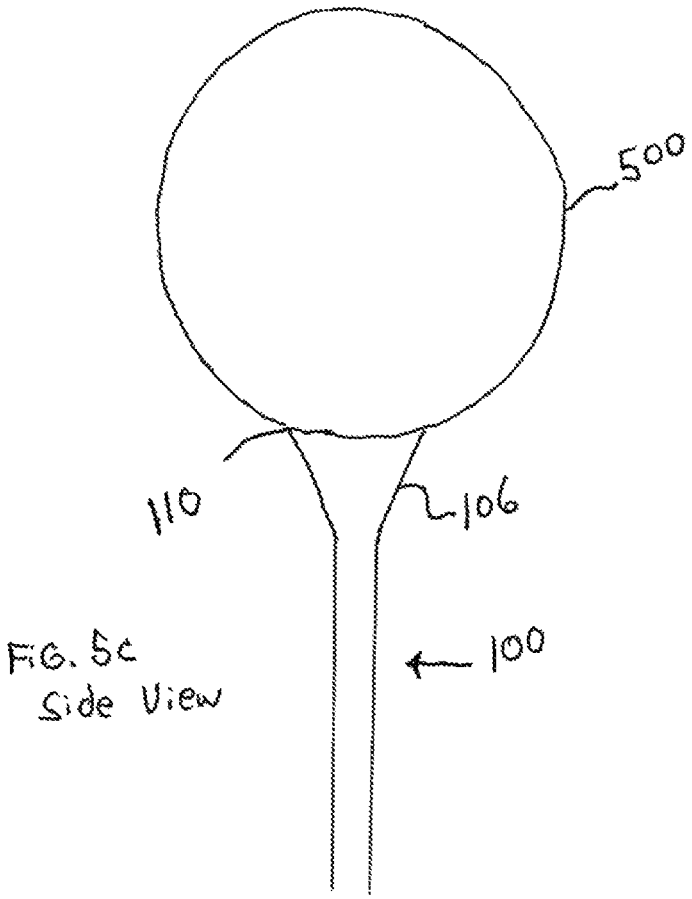
FIG. 5*c* is an illustration of side view of a golf tee according to an embodiment of the present invention.

FIG. 5*a* shows device 400 with a golf ball 500 set thereon, according to an embodiment of the present invention. FIG. 5*b* shows a tee 100 from the front with a golf ball 500 setting thereon. FIG. 5*c* shows tee 100 from the front with a golf ball 500 setting thereon from the side.

Figure 6A:
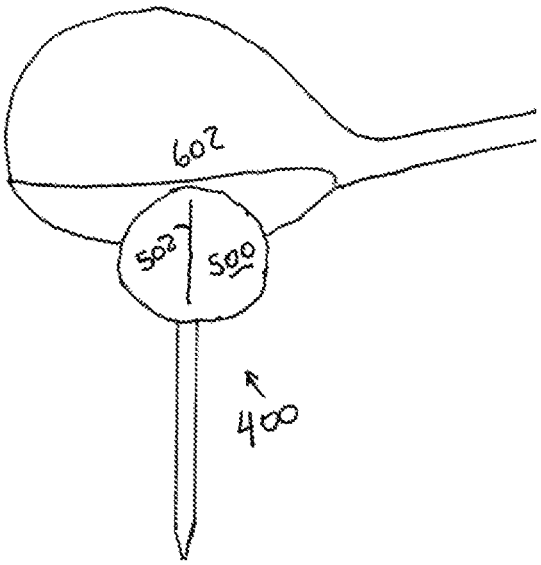
FIG. 6*a* is a picture of an aiming device taking from the top, with a golf ball sitting atop the aiming device and a golf driver positioned in a straight alignment, according to an embodiment of the present invention.

FIG. 6*a* shows a top view of a golf ball 500 sitting upon device 400 (partially blocked from view), according to an embodiment of the present invention. As shown, the aiming device 400 includes one tee 1*b*, which's shaft acts helps assist with aiming the shot and aligning the club 600. As shown, a line 502, or the like, can be provided on the ball 500 for alignment as well. Further, an alignment mark 602 could be added to the club head 600 as well, as shown.

According to embodiments of the present invention, the bore or groove 108 may be formed in cylinder shape approximately ¼ inch long with a slit or cut on the back. The slit or cut out allows the cylinder to deform slightly if needed to accommodate larger shaft diameters. The cylinder should be configured to accommodate most plastic or wooden golf tees.

The device can be handcrafted, 3D printed, stamp formed, carved or plastic injection molded.

Multiple tees 100 may be coupled together to form any number of aiming arrangements, such as for training. Additional tees can be attached to standard tees or other tees according to this invention, as well to identify different types of swing paths. This allows the player to attempt draws, fades or straight shots. For example 2 tees 100 can be attached to another clip tee or to a plastic or wooden tee. One of the tees 100 can designate a straight line shot. The other tee 100 can be oriented to designate a more technical shot such as a draw or a fade depending on which direction the player would like their ball to go.

Figure 6B:
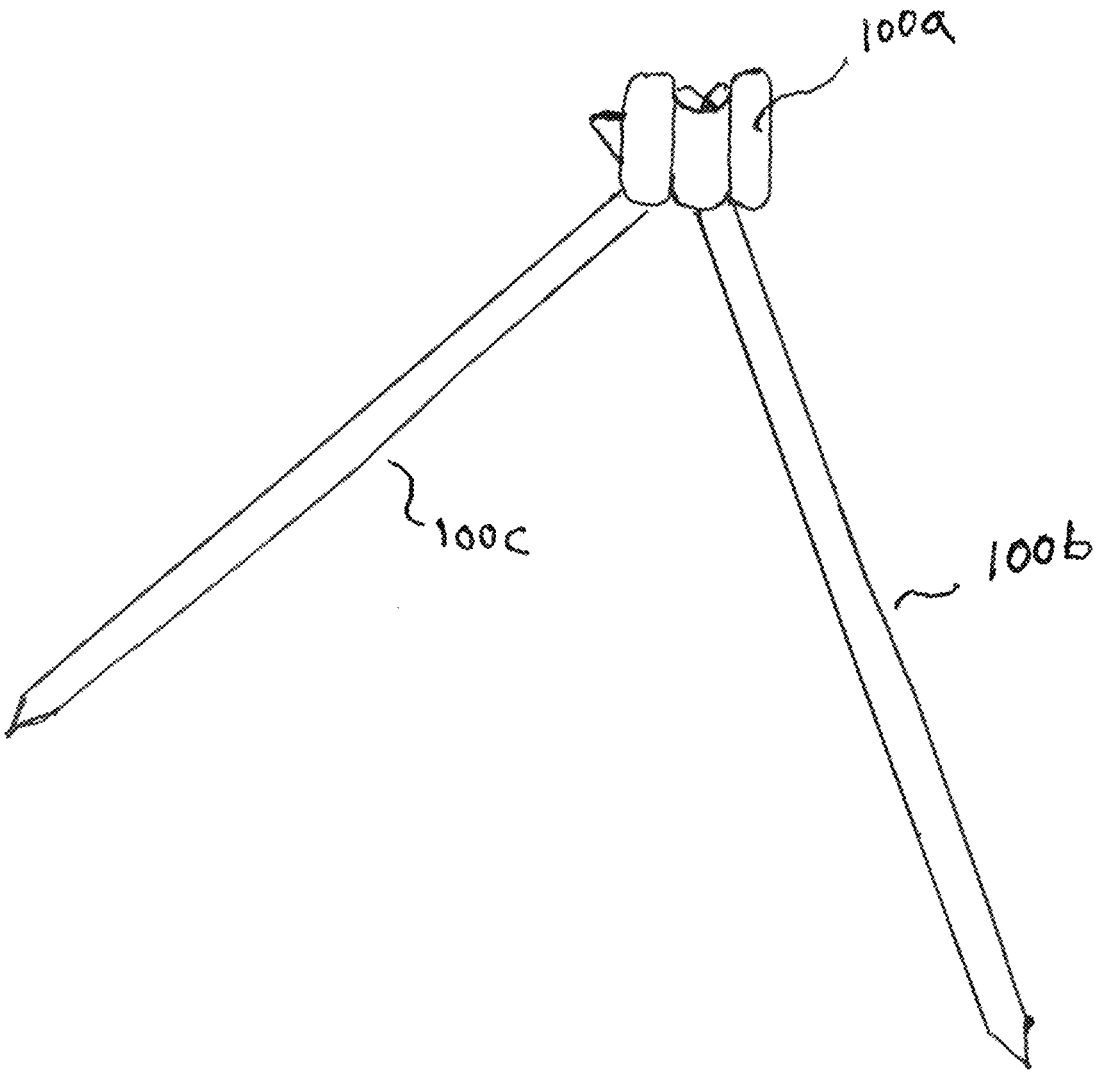
FIG. 6*b* is a picture of an aiming device with two tees coupled to the shaft of a tee, to illustrate two different angles, according to an embodiment of the present invention.

For example, as shown in FIG. 6*b*, two tees 100*b* and 100*c* can be coupled to the shaft to tee 100*a*, to illustrate two different angles. As shown in FIG. 6*c*, three tees, 100*b*, 100*c*, and 100*d* are coupled to tee 100*a* (under ball 500) for a different training arrangement.

Figure 7:
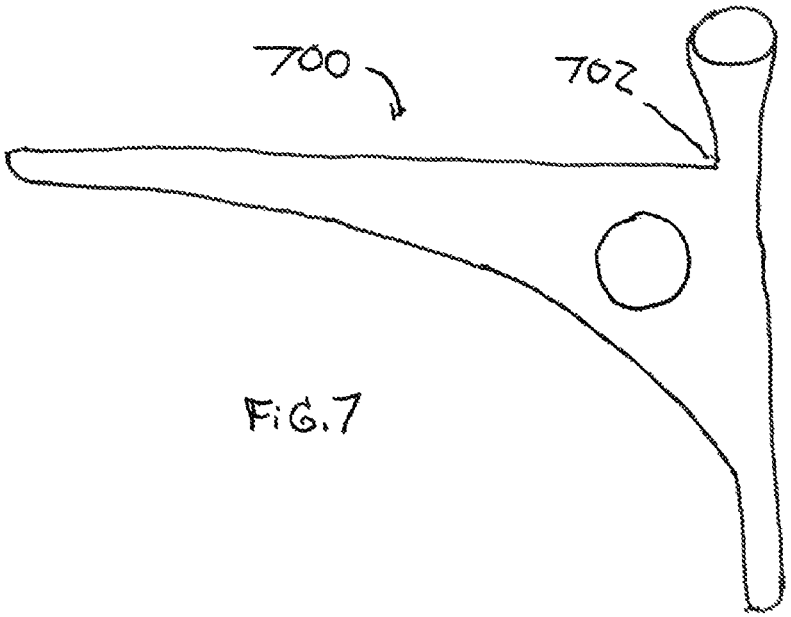
FIG. 7 is a side view of an aiming device according to another embodiment of the present invention.

FIG. 7 illustrates an aiming device 700 according to another embodiment of the present invention. This embodiment is known as the flag tee. The flag tee is preferably one piece stand-alone golf tee shaped like a flag. Like any other golf tee, it can be inserted into a playing surface but is provided with the permanently attached sight line 702 to determine ball flight direction, and it can support a golf ball.

Figure 8A:
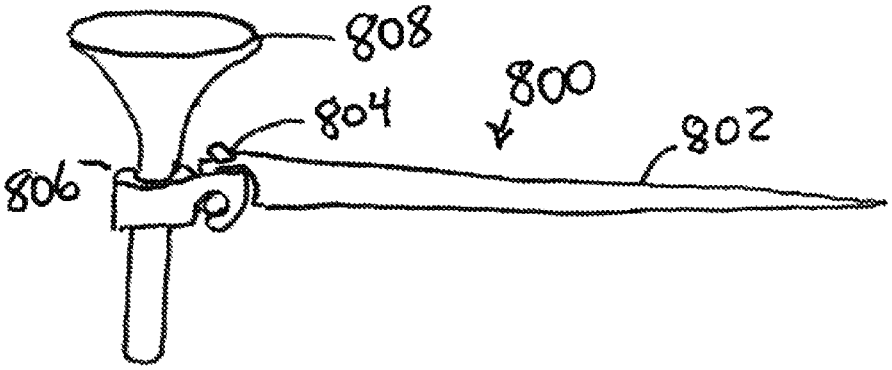
FIG. 8A is an illustration of a side view of an aiming device in a pointing position according to another embodiment of the present invention.

FIG. 8*a-c* illustrate an aiming device according to another embodiment of the present invention. A small aiming device 800 is configured to be fitted to most plastic or wooden golf tees, which allows the player to most accurately align their golf ball to the most effective target line. The device 800 may include a hinge 804 that allows a pointer portion 802 to be flip up the "sight line" so that it is perpendicular to the golf tee as shown in FIG. 8*a*. The aiming device includes a coupling mechanism 806 for clamping or attaching to the tee (808). As shown in FIG. 8*b*, the aiming device 800 may be moved to a vertical position parallel to the tee 808. FIG. 8C shows a close up of the coupling portion 806 and the hinge 804. As shown, a deformable circular portion 806 can be formed to clip to the tee 808. A hinge 804 may include a deformable receiving portion 812 for receiving an element of the pointing portion 802. An extension 810 can be provide to be received by a second receiving portion 812 so as to hold the pointing portion 802 in a horizontal position. Deformable materials are preferably used.

When a player moves into the proper position to address the golf ball, tee, device combo, the golf player is a able to use the flipped up perpendicular sight line 802 and mounted ball on tee combo to properly align the players feet and body position to match the desired swing arc that should yield the most desired ball flight upon properly and correctly striking the golf ball with the golf club head. If body mechanics and swing technique are executed properly the result should yield more consistent and more accurate golf ball flight paths resulting in better ball position hence adding to a player improving their score sheet.

The device 800 may be connected onto a tee by snapping it onto the shaft or inserting the shaft into the cylinder. Once inserted, the device 800 may be slided up to and close to the crown of the golf tee, or just far enough to help indicate how much depth to insert the golf tee into the ground. Once used, the sight line 802 maybe be moved from perpendicular position to parallel position and store for future use.

Figure 9:
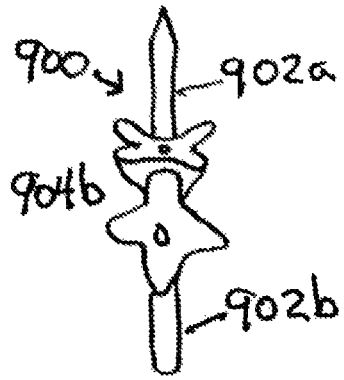
FIG. 9 is a perspective view of an aiming device according to another embodiment of the present invention.

FIG. 9 illustrates another embodiment of the present invention. An aiming device 900 may include a "stick tee" 902*b* which includes a single diameter hole 904*b* in the crown area that is perpendicular to the shaft 902*b*. This limits the types of tees that can be used and inserted into the hole to create the horizontal sight line. Since the "hole" is of one specific diameter, only tee shafts of the same diameter can fit into the hole.

Figure 10A:
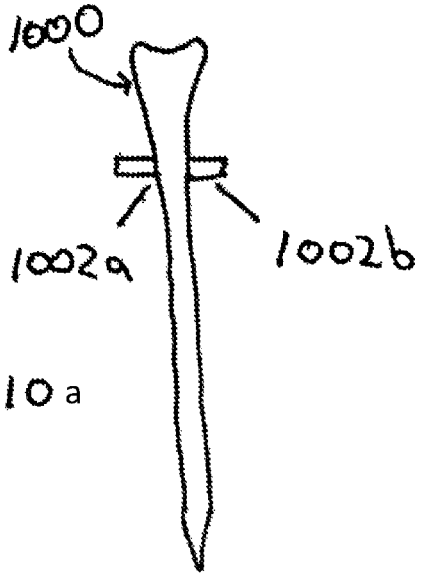
FIG. 10*a* is a side view of a golf tee according to an embodiment of the present invention.
Figure 10B:
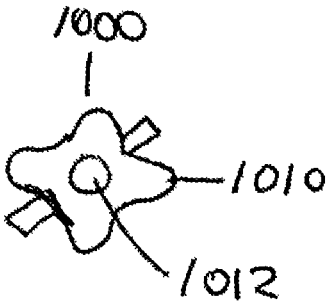
FIG. 10*b* is a top view of a golf tee according to an embodiment of the present invention.

FIG. 10*a*-10*b* illustrate another tee according to another embodiment of the present invention. "Post tee" 1000 is a standard size golf tee that is outfitted with 2 equal sized posts 1002*a*, 1002*b*, connected to the shaft just underneath the crown of the tee. A hole 1012 is provided in the top surface 1010 of tee 1000 for receiving a post 1002 in a detachably coupling manner. For example, post could be provided that are approximately ⅛ in long and approximately 1/16 in in diameter. The posts are preferably on opposing sides of one another In the top and center of each post tee crown would be provided with a hole that is approximately 1/16 in wide and ⅛ inch deep.

Figure 11:
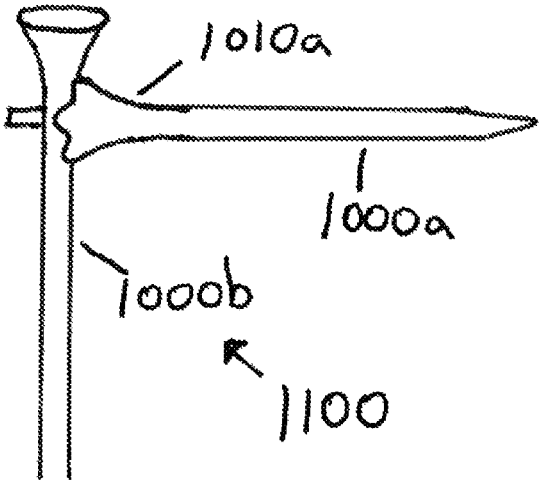
FIG. 11 is a side view of an aiming device formed from the golf tee of FIGS. 10*a-b* according to an embodiment of the present invention.

FIG. 11 shows an aiming device 1100 formed by coupling a tee 1000*a* to the post of another tee 1000*b*. As shown, the crown portion 1010*a* of tee 1000*a* is shape to match the exterior shape of the shaft of tee 1000*b*. Tee 1000*a* can be inserted into a playing surface in a vertical position for holding a golf ball and tee 1000*b* will be in the horizontal position acting as a sight line to point in the desired direction of ball flight. Each post tee 1000 can be used individually to hold a golf ball or in combination with another to indicate to the player the desired ball direction.

According to embodiments of the present invention, each tee or device, or components thereof, may be formed out of suitable materials, such as hard or soft plastics, nylon resin, PVC, fiber filled plastics, polyethylene, wood, composite, metal, etc., and maybe be formed to be rigid or deformable.

Thus, a number of preferred embodiments have been fully described above with reference to the drawing figures. Although the invention has been described based upon these preferred embodiments, it would be apparent to those of skill in the art that certain modifications, variations, and alternative constructions could be made to the described embodiments within the spirit and scope of the invention. Although the various configurations have been described in language specific to structural features and/or methodological acts, it is to be understood that the subject matter defined in the Figures is not necessarily limited to the specific features or acts described. Rather, the specific features and acts are disclosed as example forms of implementing the claimed subject matter.

What is claimed is:

1. An aiming device comprising a first golf tee and second golf tee, each of said first gold tee and said second golf tee comprising:

a shaft having a tapered distal end;

a platform coupled with an end of said shaft opposite of said tapered end, said platform having a top surface that is concave in shape and configured to hold a golf ball and a groove passing entirely through the platform perpendicular to the axis of said shaft, said groove extending in the direction of the axis of the shaft through the top surface of said platform, bisecting said top surface to form first and second opposing portions of said platform, and said groove including a bore section;

wherein said shaft has a same sized diameter from said tapered distal end to said platform;

wherein said bore section of said groove being larger in diameter than a width of said groove measured at the point where said groove bisects said top surface in a direction perpendicular to the axis of said bore section, and has a diameter sized to fasten said platform to a shaft of another golf tee having a same sized diameter shaft between said tapered distal end and said platform;

said aiming device is formed by clamping said first golf tee onto a third golf tee by inserting a shaft of said third golf tee through the bore section of the groove of said first golf tee so that a distal end of a shaft of said first tee is on one end of the third tee and a platform on said first tee is on a second end of said third tee;

said second golf tee being clamped onto the shaft of said third golf tee by inserting the shaft of said third golf tee through the bore section of the groove of said second golf tee.

2. The golf tee recited in claim 1, wherein at least said platform is constructed of at least a slightly deformable material so as to allow said first and second opposing portions of said platform to flex away from each other to receive the shaft of said another golf tee into the bore section of the groove and clamp onto the shaft of said another golf tee.

3. The golf tee as recited in claim 1, wherein each of said first and second golf tee is formed as a single, integrated piece.

4. The golf tee as recited in claim 1, wherein each of said first and second golf tee is formed by molding.

5. The golf tee as recited in claim 1, wherein each of said first and second golf tee is formed of metal.

6. The golf tee as recited in claim 1, wherein each of said first and second golf tee is formed of a fiber filled plastic.

7. The golf tee as recited in claim 1, where each of said first and second golf tee is formed of polyethylene or PVC.

8. The golf tee as recited in claim 1, wherein the top surface of said platform is generally square shaped.

9. The golf tee as recited in claim 1, wherein the shaft of said first and second tee is slightly tapered from said platform to said tip.

* * * * *